US007347733B2

(12) United States Patent
Murakami

(10) Patent No.: US 7,347,733 B2
(45) Date of Patent: Mar. 25, 2008

(54) ELECTRIC JUNCTION BOX

(75) Inventor: Tomoyasu Murakami, Hiroshima (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/582,961

(22) Filed: Oct. 19, 2006

(65) Prior Publication Data

US 2007/0091547 A1 Apr. 26, 2007

(30) Foreign Application Priority Data

Oct. 21, 2005 (JP) ..... P2005-307179

(51) Int. Cl.
*H01R 12/00* (2006.01)

(52) U.S. Cl. ..... 439/620.27; 439/797; 439/883; 439/908

(58) Field of Classification Search ..... 439/76.1, 439/620.26, 620.27, 620.28, 620.29, 797, 439/908, 883; 361/837; 337/235
See application file for complete search history.

(56) References Cited

U.S. PATENT DOCUMENTS

| | | | | |
|---|---|---|---|---|
| 5,088,940 | A | 2/1992 | Saito | |
| 5,645,448 | A * | 7/1997 | Hill | 439/522 |
| 6,030,257 | A * | 2/2000 | Furuya | 439/620.26 |
| 6,333,846 | B1 | 12/2001 | Hashizawa et al. | |
| 6,398,595 | B2 * | 6/2002 | Wakata et al. | 439/755 |
| 6,456,188 | B1 * | 9/2002 | Tsuchiya | 337/235 |
| 6,517,390 | B2 * | 2/2003 | Kim | 439/754 |
| 6,723,920 | B2 * | 4/2004 | Higuchi et al. | 174/50 |

FOREIGN PATENT DOCUMENTS

| | | | |
|---|---|---|---|
| EP | 1 103 998 | A2 | 5/2001 |
| EP | 1 646 063 | A2 | 4/2006 |
| JP | 08-007743 | A | 1/1996 |
| JP | 10-247450 | A | 9/1998 |
| JP | 11-213853 | A | 8/1999 |
| JP | 11-312454 | A | 11/1999 |
| JP | 2000-113803 | A | 4/2000 |
| JP | 2001-110297 | A | 4/2001 |
| JP | 2004-047189 | A | 2/2004 |

* cited by examiner

*Primary Examiner*—Neil Abrams
*Assistant Examiner*—Phuongchi Nguyen
(74) *Attorney, Agent, or Firm*—Sughrue Mion, PLLC

(57) ABSTRACT

An electric junction box including a case, an input bus bar, an output bus bar and a fuse which are accommodated within the case, wherein an input electric wire and an output electric wire are electrically connected to the input bus bar and the output bus bar, respectively, the electric junction box further including an input-side fastening member which fastens an input terminal of the fuse and the input bus bar to the case in such a state that the input terminal is laid to overlap the input bus bar, and an output-side fastening member which fastens an output terminal of the fuse and the output bus bar to the case in such a state that the output terminal is laid to overlap the output bus bar, wherein the input-side fastening member and the output-side fastening member are conductive and are passed through the case, and a connecting terminal of the input electric wire is fastened to the case at a distal end portion of the input-side fastening member which is exposed from the case, and a connecting terminal of the output electric wire is fastened to the case at a distal end portion of the output-side fastening member which is exposed from the case.

1 Claim, 3 Drawing Sheets

ELECTRIC JUNCTION BOX

BACKGROUND OF THE INVENTION

1. Field of the Invention

The present invention relates to an electric junction box which functions to distribute a power supply and protect a circuit.

2. Related Art

An electric junction box is installed on a vehicle such a motor vehicle for distribution of a power supply and protection of a circuit. As a conventional electric junction box, there has been known an electric junction box as shown in FIG. 5 (for example, refer to JP-A-2004-47189).

As is shown in FIG. 5, an electric junction box disclosed in JP-A-2004-47189 is a fuse box in which a battery fuse 110 and an input bus bar 115 and an output bus bar 116 which are connected to terminals of the battery fuse 110 are accommodated in an interior of a case which is made up of a lower cover 112, an upper cover 113 and a case main body 114.

An input terminal 110*b* of the battery fuse 110 is laid to overlap a distal end of the input bus bar 115 with a threaded portion 115*a* provided at a distal end portion of the input bus bar 115 in such a manner as to project therefrom passed through a through hole provided in the input terminal 110*b*, so as to be fastened in place with a nut N. Similarly, an output terminal 110*c* of the battery fuse 110 is laid to overlap a distal end of the output bus bar 116 with a threaded portion 116*a* provided at a distal end portion of the output bus bar 116 in such a manner as to project therefrom passed through a through hole provided in the output terminal 110*c*, so as to be fastened in place with a nut N.

Then, a battery terminal 120 connected under pressure to a distal end of an electric wire W1 of a power supply circuit has a pair of fastening pieces 122, 123 which fit on a battery post 102 which is provided on an upper surface of a battery box 101 in such a manner as to project therefrom, and distal end portions of these fastening pieces 122, 123 are overlapped on a connecting piece 115*b* provided at a proximal end portion of the input bus bar 115, so as to be fastened with a bolt and a nut. In addition, a terminal 125 of an electric wire W2 which connects to a relay box is laid to overlap a proximal end portion of the output bus bar 116 with a threaded portion 116*b* provided on the proximal end portion of the output bus bar 116 in such a manner as to project therefrom passed through a through hole provided in the terminal 125, so as to be fastened with a nut N.

Note that conventionally, there have been known various types of fuses which are adapted to be fastened to bus bars or the like with bolts and nuts (for example, refer to JP-A-2001-110297, JP-A-2000-113803, JP-A-11-312454, JP-A-11-213853 and JP-A-8-7743).

In the electric junction box disclosed in JP-A-2004-47189, in addition to the threaded portion 115*a* and the nut N which function as a fastening member for electrically connecting the input terminal 110*b* of the battery fuse 110 to the input bus bar 115, the bolt and the nut N are provided as a fastening member for electrically connecting the battery terminal 120 of the electric wire W1 of the power supply circuit to the input bus bar 115. Similarly, in addition to the threaded portion 116*a* and the nut N which function as a fastening member for electrically connecting the output terminal 110*c* of the battery fuse 110 to the output bus bar 116, the bolt and the nut N are provided as a fastening member for electrically connecting the terminal 125 of the electric wire W2 which connects to the relay box to the output bus bar 116.

Thus, in the electric junction box disclosed in JP-A-2004-47189, the exclusive fastening members are necessary to electrically connect the input terminal 110*b* and the output terminal 110*c* of the battery fuse 110, as well as the battery terminal 120 of the electric wire W1 and the terminal 125 of the electric wire W2 to the input bus bar 115 and the output bus bar 116, respectively, and the number of manhours necessary to fasten the fastening members is increased, these having constituted a root cause for an increase in the production costs of the electric junction box 111.

In addition, in the electric junction box disclosed in JP-A-2004-47189, since the exclusive fastening members are provided as has been described above, a wide space has had to be occupied by the fastening members in the interior of the case, and the number of fuses and other electric components that can be accommodated in the interior of the case has had to be reduced.

SUMMARY OF THE INVENTION

The invention was made in view of the situations described above, and an object thereof is to provide an electric junction box which can realize a reduction in production costs and an increase in the number of electric components that can be accommodated therein.

The object is to be achieved by an electric junction box which will be described below under (1).

(1) An electric junction box including a case, an input bus bar and an output bus bar which are accommodated within the case and a fuse accommodated within the case in such a manner as to bridge the input bus bar and the output bus bar, wherein an input electric wire and an output electric wire are electrically connected to the input bus bar and the output bus bar, respectively, the electric junction box further including an input-side fastening member which fastens an input terminal of the fuse and the input bus bar to the case in such a state that the input terminal is laid to overlap the input bus bar, and an output-side fastening member which fastens an output terminal of the fuse and the output bus bar to the case in such a state that the output terminal is laid to overlap the output bus bar, wherein the input-side fastening member and the output-side fastening member are conductive and are passed through the case, and a connecting terminal of the input electric wire is fastened to the case at a distal end portion of the input-side fastening member which is exposed from the case, and a connecting terminal of the output electric wire is fastened to the case at a distal end portion of the output-side fastening member which is exposed from the case.

According to the electric junction box which is configured as described under (1) above, the input terminal of the fuse and the connecting terminal of the input electric wire are electrically connected to the input bus bar by the common input-side fastening member, and the output terminal of the fuse and the connecting terminal of the output electric wire are electrically connected to the output bus bar by the common output-side fastening member, whereby not only the number of fastening members can be reduced so as to realize a reduction in the production costs of the electric junction box but also the number of electric components that can be accommodated in the electric junction box can be increased. Furthermore, according to the electric junction box configured according to the invention, the input-side fastening member which fastens together the input terminal of the fuse and the input bus bar in the overlapping fashion within the case is passed through the case, and the connecting terminal of the input electric wire is fastened to the case at the distal end portion of the input-side fastening member which is exposed to the outside of the case. In addition, the output-side fastening member which fastens together the output terminal of the fuse and the output bus bar in the overlapping fashion within the case is passed through the case, and the connecting terminal of the output electric wire is fastened to the case at the distal end portion of the output-side fastening member which is exposed to the outside of the case. By adopting this configuration, when so fastening to the case the connecting terminals of the input electric wire and the output electric wire which are to be attached to the electric junction box after the fabrication thereof, since the fastening of the input terminal of the fuse to the input bus bar and the output terminal of the fuse to the output bus bar does not have to be released and hence, not only a superior workability is provided but also the input terminal of the fuse and the input bus bar, and the output terminal of the fuse and the output bus bar can be kept fastened together strongly and rigidly, thereby making it possible to prevent the dislodgement of the fuse, input bus bar and output bus bar from the case.

In this way, according to the invention, the production costs of the electric junction box can be reduced, and furthermore, the number of electric components that can be accommodated within the electric junction box can be increased.

DETAILED DESCRIPTION OF THE PREFERRED EMBODIMENTS

Hereinafter, a preferred embodiment of an electric junction box of the invention will be described in detail based on the drawings.

Figure 1:
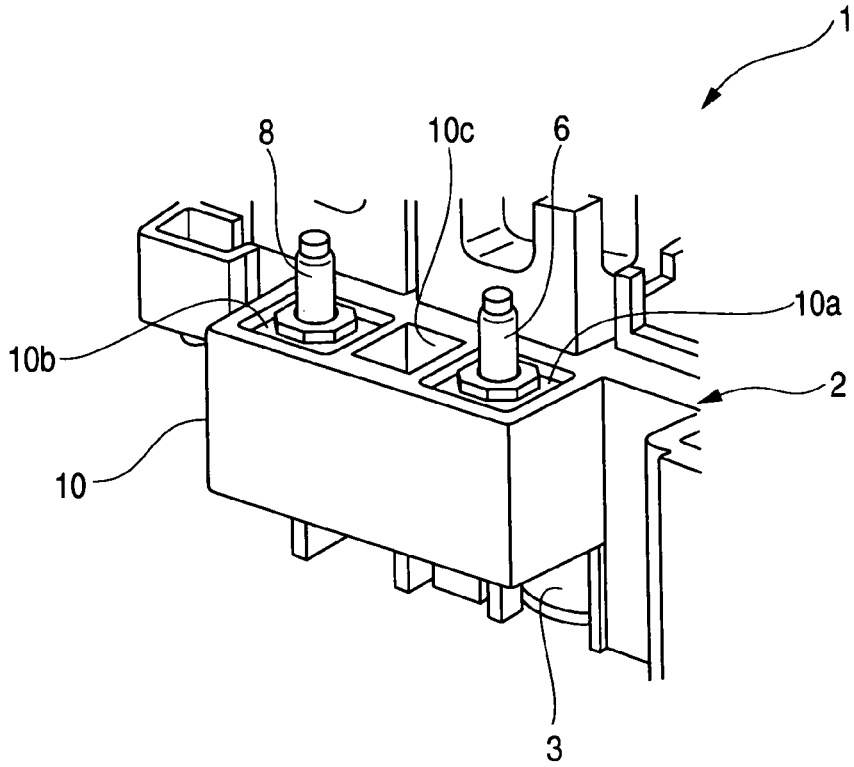
FIG. 1 is a perspective of a main part of an embodiment of an electric junction box of the invention.
Figure 2:
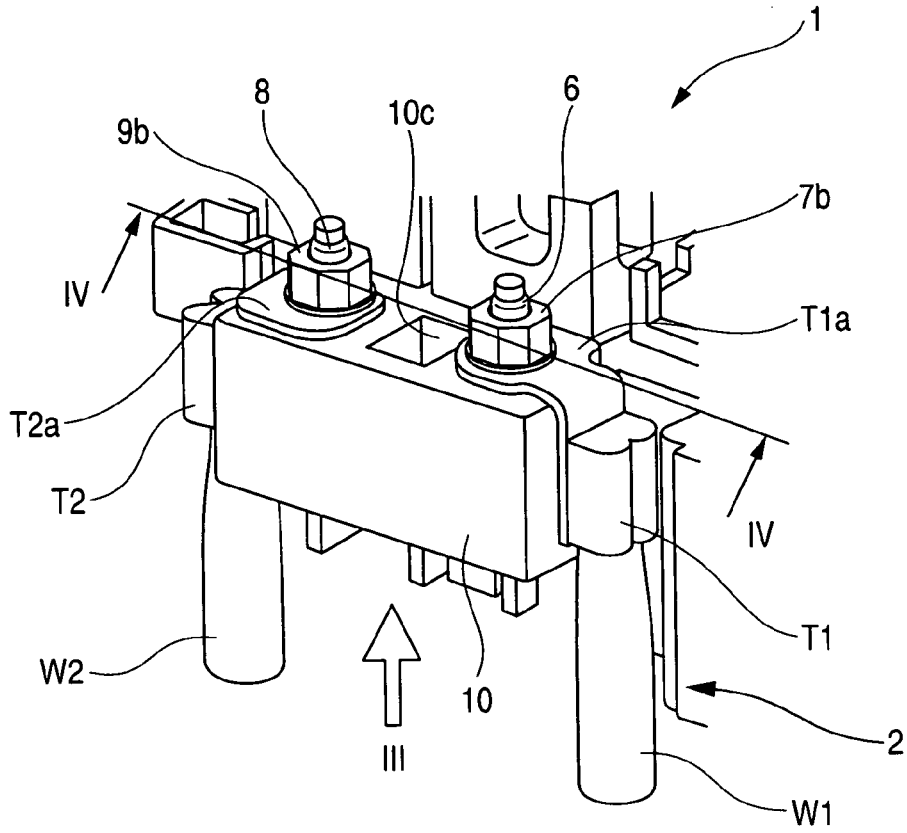
FIG. 2 is a perspective view showing a state in which an input electric wire and an output electric wire are attached to the electric junction box shown in FIG. 1.
Figure 3:
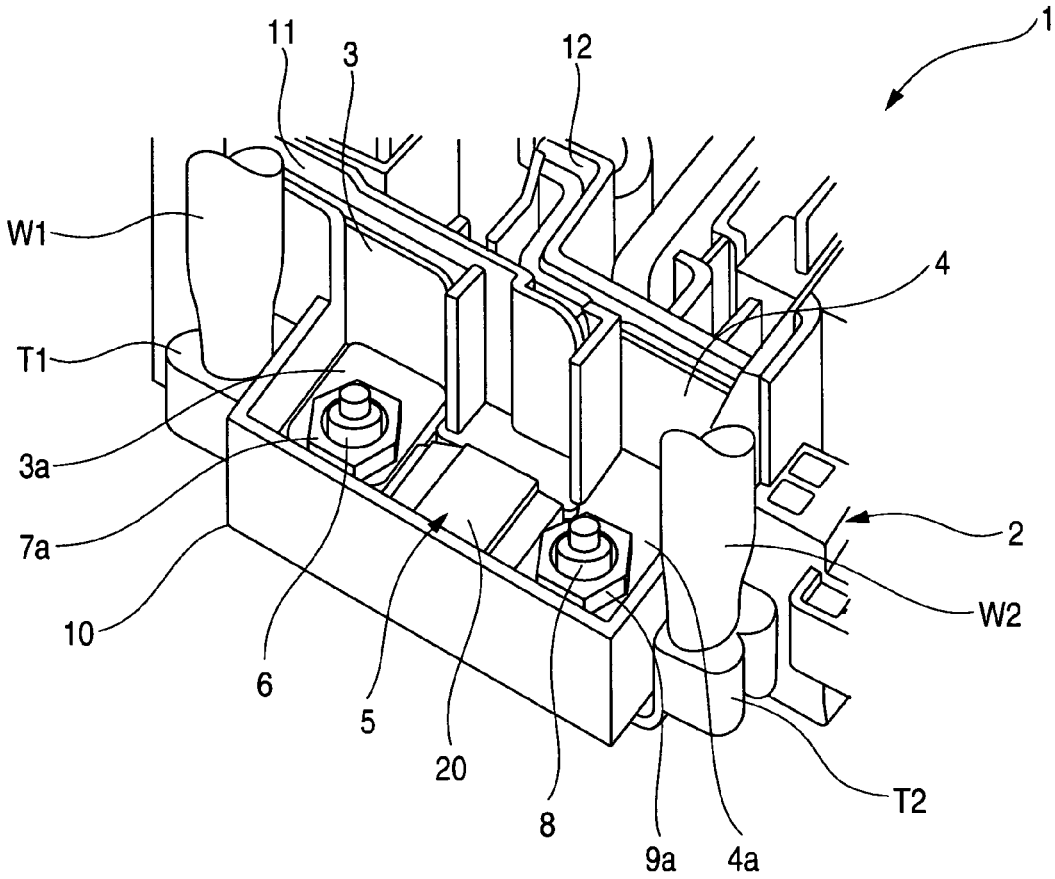
FIG. 3 is a perspective view of the electric junction box as seen in a direction indicated by an arrow III in FIG. 2.
Figure 4:
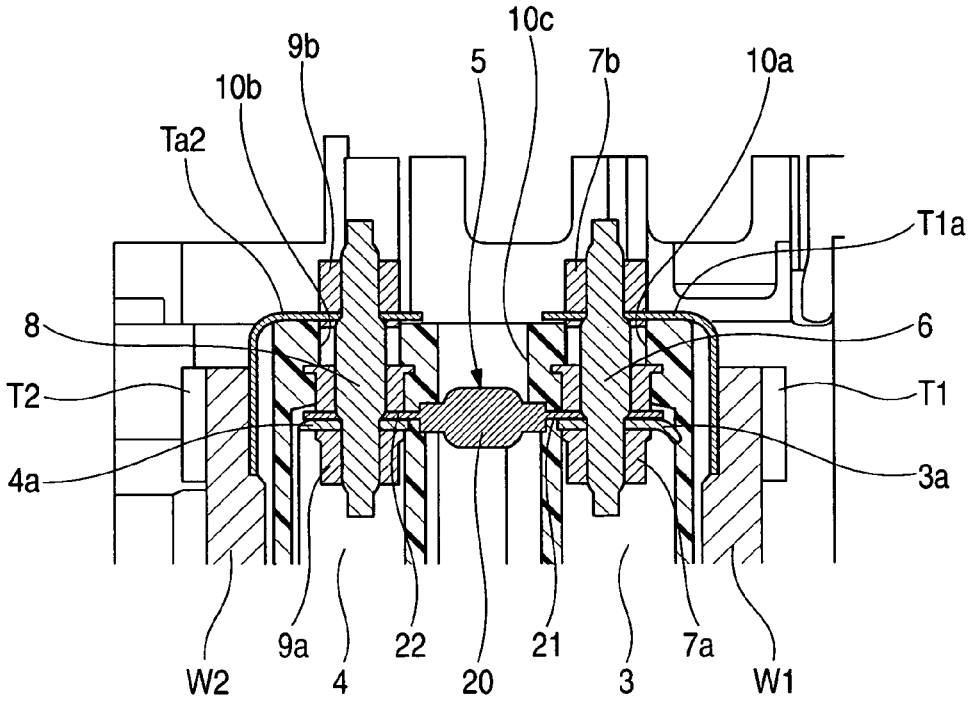
FIG. 4 is a sectional view taken along the line IV-IV in FIG. 2 and seen in a direction indicated by arrows attached to the line.
Figure 5:
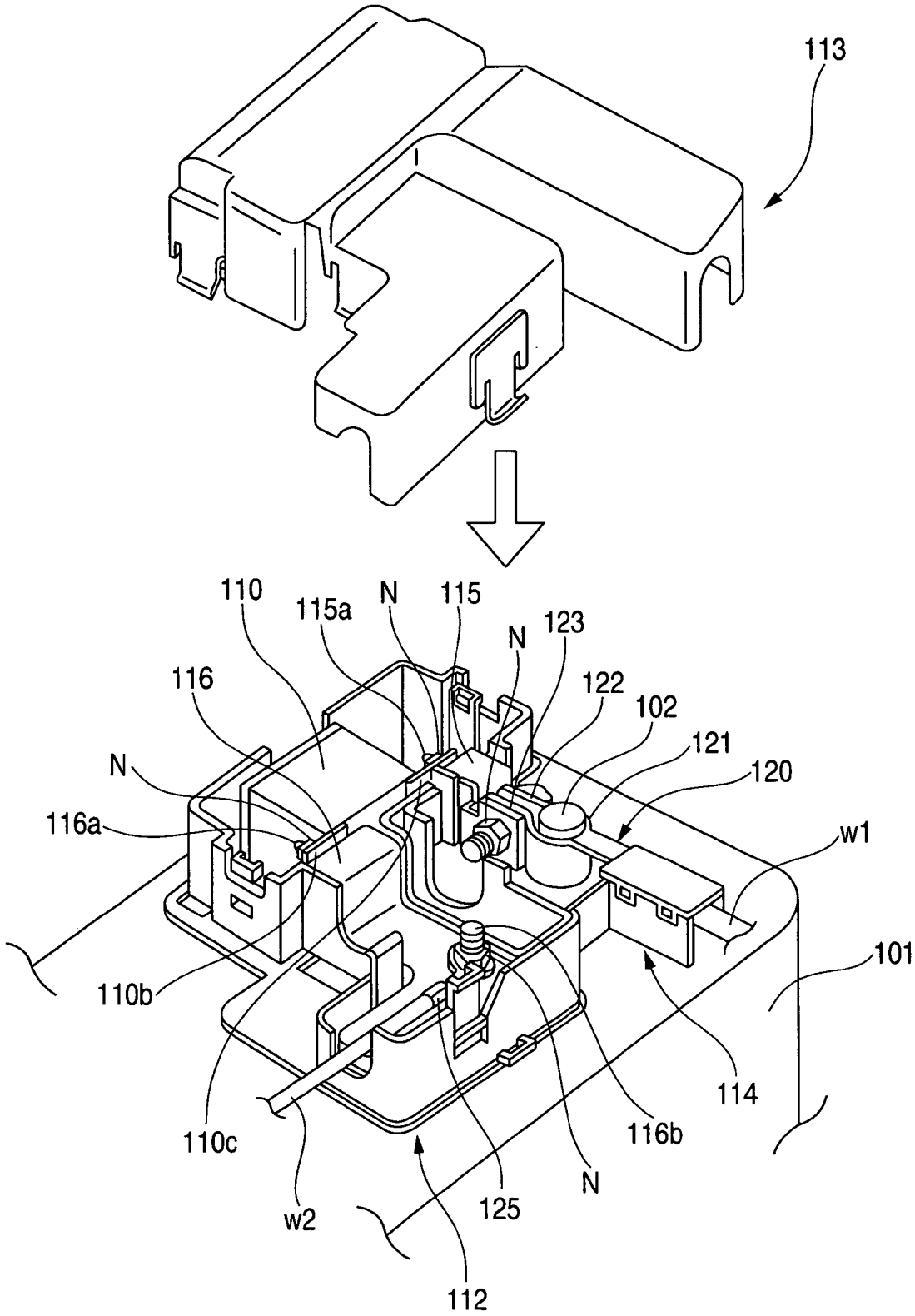
FIG. 5 is an exploded perspective view of a conventional electric junction box.

FIG. 1 is a perspective view of a main part of an embodiment of an electric junction box of the invention, FIG. 2 is a perspective view showing a state in which an input electric wire and an output electric wire are attached to the electric junction box shown in FIG. 1, FIG. 3 is a perspective view of the electric junction box as seen in a direction indicated by an arrow III in FIG. 2, and FIG. 4 is a sectional view taken along the line IV-IV in FIG. 2 and seen in a direction indicated by arrows attached to the line.

As is shown in FIGS. 1 to 3, an electric junction box 1 of this embodiment is installed on a vehicle such as a motor vehicle and is made up of a case 2 which is assembled to a vehicle body, an input bus bar 3 and an output bus bar 4, and a fuse 5.

The case 2 is formed from, for example, an insulating resin material, and a box-shaped fuse mounting portion 10 which is made to open downward is provided on part of a side wall thereof. The fuse 5 is inserted into an interior of the fuse mounting portion 10 from below, so as to be accommodated in place within the fuse mounting portion 10.

The input bus bar 3 and the output bus bar 4 are stamped out from a metallic plate and bent into a predetermined shape and are inserted into bus bar laying out paths 11, 12, respectively, which are provided within the case 2, so as to be accommodated within the case 2. The bus bar laying out paths 11, 12 reach the fuse mounting portion 10, and the input bus bar 3 and the output bus bar 4 project into the fuse mounting portion 10 at their distal end portions 3*a*, 4*a*. In addition, various types of electric components accommodated within the case such as relays are connected properly to the input bus bar 3 and the output bus bar 4 so as to form a predetermined circuit.

The fuse 5 is a so-called flat plate-type fuse, and a flat plate-shaped input terminal 21 is provided on one side edge of a fusible portion 20 which is formed into a substantially rectangular shape as seen from the top thereof, while a flat plate-shaped output terminal 22 is provided on the other side edge of the fusible portion 20 which is paired with the one side edge. The fuse 5 is disposed within the fuse mounting portion 10 in such a manner as to cause the fusible portion 20, the input terminal 21 and the output terminal 22 to extend along an inner surface of an upper wall of the fuse mounting portion 10.

The distal end portion 3*a* of the input bus bar 3 which projects into the fuse mounting portion 10 is disposed in such a manner as to overlap the input terminal 21 of the fuse 5, and similarly, the distal end portion 4*a* of the output bus bar 4 which projects into the fuse mounting portion 10 is disposed in such a manner as to overlap the output terminal 22 of the fuse 5. Namely, the fuse 5 is provided in such a manner as to bridge the distal end portion 3*a* of the input bus bar 3 and the distal end portion 4*a* of the output bus bar 4.

A through hole is pierced in the input terminal 21 of the fuse 5 in such a manner as to penetrate therethrough in a thickness direction, and a through hole is pierced in the distal end portion 3*a* of the input bus bar 3 in such a manner as to penetrate therethrough in a thickness direction so as to continue to the thorough hole in the input terminal 21 in such a state that the distal end portion 3*a* overlaps the input terminal 21. In addition, a through hole 10*a* is pierced in the upper wall of the fuse mounting portion 10 in such a manner as to penetrate therethrough so as to continue to the through holes provided in the input terminal 21 of the fuse 5 and the distal end portion 3*a* of the input bus bar 3.

Similarly, a through hole is pierced in the output terminal 22 of the fuse 5 in such a manner as to penetrate therethrough in a thickness direction, and a through hole is pierced in the distal end portion 4*a* of the output bus bar 4 in such a manner as to penetrate therethrough in a thickness direction so as to continue to the thorough hole in the output terminal 22 in such a state that the distal end portion 4*a* overlaps the output terminal 22. In addition, a through hole 10*b* is pierced in the upper wall of the fuse mounting portion 10 in such a manner as to penetrate therethrough so as to continue to the through holes provided in the output terminal 22 of the fuse 5 and the distal end portion 4*a* of the output bus bar 3.

A bolt 6, which constitutes a constituent element of an input-side fastening member, is passed through the through hole 10*a* provided in the upper wall of the fuse mounting portion 10, while a bolt 8, which constitutes a constituent element of an output-side fastening member, is passed through the through hole 10*b*. The bolts 6, 8 are press fitted in the through holes 10*a*, 10*b* or screwed into nuts embedded in the through holes 10*a*, 10*b*, respectively, so as to be fixed to the upper wall of the fuse mounting portion 10.

A proximal end portion of the bolt 6 which projects into the fuse mounting portion 10 is passed through the through holes in the distal end portion 3*a* of the input side bus bar 3 and the input terminal 21 of the fuse 5, and a nut 7*a*, which constitutes a constituent element of the input-side fastening member, is screwed on to the proximal end portion of the bolt 6, whereby the distal end portion 3*a* of the input bus bar 3 and the input terminal 21 of the fuse 5 are fastened to the upper wall of the fuse mounting portion 10 in such a state that the distal end portion 3*a* and the input terminal 21 overlap each other.

Similarly, a proximal end portion of the bolt 8 which projects into the fuse mounting portion 10 is passed through the through holes in the distal end portion 4*a* of the output side bus bar 4 and the output terminal 22 of the fuse 5, and a nut 9*a*, which constitutes a constituent element of the input-side fastening member, is screwed on to the proximal end portion of the bolt 8, whereby the distal end portion 4*a* of the output bus bar 4 and the output terminal 22 of the fuse 5 are fastened to the upper wall of the fuse mounting portion 10 in such a state that the distal end portion 4*a* and the output terminal 22 overlap each other.

Here, a through hole 10*c* is pierced in a portion of the upper wall of the fuse mounting portion 10 which lies right above the fusible portion 20 of the fuse 5, that is, a portion which lies between the through holes 10*a*, 10*b* through which the bolts 6, 8 are passed, in such a manner as to penetrate through the upper wall. It is designed that the state of the fusible portion 20 of the fuse 5 (that is, whether or not the fusible portion 20 is fused) can be confirmed through this through hole 10*c* from the outside.

In addition, for example, an electric wire W1 connected to a battery installed on the vehicle and, for example, an electric wire W2 connected to an alternator installed on the vehicle are attached to the electric junction box after the fabrication thereof. Connecting terminals T1, T2 are crimped to terminal ends of the electric wires W1, W2, respectively.

The terminal end of the electric wire W1 is disposed on the outside of the fuse mounting portion 10 along a side wall of the fuse mounting portion 10 which lies closer to the bolt 6, and the connecting terminal T1 which is crimped to this terminal end is bent substantially at right angles at a distal end thereof which is formed into a flat plate shape, a through hole being pierced in this distal end portion T1*a* in such a manner as to penetrate therethrough in a thickness direction. Then, the distal end portion T1*a* is placed on the upper wall of the fuse mounting portion 10 while a distal end portion of the bolt 6 which is exposed to the outside from the upper wall of the fuse mounting portion 10 is being passed through the through hole provided in the distal end portion T1*a*, and a nut 7*b*, which constitutes a constituent element of the input-side fastening member, is screwed on to the distal end portion of the bolt 6, whereby the connecting terminal T1 is fastened to the upper wall of the fuse mounting portion 10.

Similarly, the terminal end of the electric wire W2 is disposed on the outside of the fuse mounting portion 10 along a side wall of the fuse mounting portion 10 which lies closer to the bolt 8, and the connecting terminal T2 which is crimped to this terminal end is bent substantially at right angles at a distal end thereof which is formed into a flat plate shape, a through hole being pierced in this distal end portion T2*a* in such a manner as to penetrate therethrough in a thickness direction. Then, the distal end portion T2*a* is placed on the upper wall of the fuse mounting portion 10 while a distal end portion of the bolt 8 which is exposed to the outside from the upper wall of the fuse mounting portion 10 is being passed through the through hole provided in the distal end portion T2*a*, and a nut 9*b*, which constitutes a constituent element of the input-side fastening member, is screwed on to the distal end portion of the bolt 8, whereby the connecting terminal T2 is fastened to the upper wall of the fuse mounting portion 10.

The bolt 6 and nuts 7*a*, 7*b* and the bolt 8 and the nuts 9*a*, 9*b* are made of a metal, for example, and they are all conductive. Then, the input terminal 21 of the fuse 5 and the distal end portion 3*a* of the input bus bar 3 are made to overlap each other so as to be electrically connected to each other, and the input terminal 21 of the fuse 5 and the distal end portion 3*a* of the input bus bar 3, and the connecting terminal T1 of the electric wire W1 are electrical connected to each other via the conductive bolt 6 and nuts 7*a*, 7*b*. Similarly, the output terminal 22 of the fuse and the distal end portion 4*a* of the output bus bar 4 are made to overlap each other so as to be electrically connected to each other, and the output terminal 22 of the fuse 5 and the distal end portion 4*a* of the output bus bar 4, and the connecting terminal T2 of the electric wire W2 are electrically connected to each other via the conductive bolt 8 and nuts 9*a*, 9*b*.

As has been described heretofore, according to the electric junction box 1 of the embodiment, the input terminal 21 of the fuse 5 and the connecting terminal T1 of the input electric wire W1 are electrically connected to the input bus bar 3 by the common input-side fastening members 6, 7*a*, 7*b*, and the output terminal 22 of the fuse 5 and the connecting terminal T2 of the output electric wire W2 are electrically connected to the output bus bar 4 by the common output-side fastening members 8, 9*a*, 9*b*, whereby not only the number of fastening members can be reduced so as to realize a reduction in the production costs of the electric junction box 1 but also the number of electric components that can be accommodated in the electric junction box 1 can be increased.

Furthermore, according to the electric junction box 1 of the embodiment, the input-side fastening member 6 which fastens together the input terminal 21 of the fuse 5 and the input bus bar 3 in the overlapping fashion within the case 2 is passed through the case 2, and the connecting terminal T1 of the input electric wire W1 is fastened to the case 2 at the distal end portion of the input-side fastening member 6 which is exposed to the outside of the case 2. In addition, the output-side fastening member 8 which fastens together the output terminal 22 of the fuse 5 and the output bus bar 4 in the overlapping fashion within the case 2 is passed through the case 2, and the connecting terminal T2 of the output electric wire W2 is fastened to the case 2 at the distal end portion of the output-side fastening member 8 which is exposed to the outside of the case 2. By adopting this configuration, when so fastening to the case 2 the connecting terminals T1, T2 of the input electric wire W1 and the output electric wire W2 which are to be attached to the electric junction box 1 after the fabrication thereof, since the fastening of the input terminal 21 of the fuse 5 to the input bus bar 3 and the output terminal 22 of the fuse 5 to the output bus bar 4 does not have to be released and hence, not only a superior workability is provided but also the input terminal 21 of the fuse 5 and the input bus bar 3, and the output terminal 22 of the fuse 5 and the output bus bar 4 can be kept fastened together strongly and rigidly, thereby making it possible to prevent the dislodgement of the fuse 5, input bus bar 3 and output bus bar 4 from the case 2.

Note that the invention is not limited to the embodiment that has been described heretofore and can be modified and improved properly.

What is claimed is:

1. An electric junction box comprising:

a case;

an input bus bar and an output bus bar which are accommodated within the case; and a fuse accommodated within the case such as to bridge the input bus bar and the output bus bar, wherein an input electric wire and an output electric wire are electrically connected to the input bus bar and the output bus bar, respectively;

an input-side fastening member which fastens an input terminal of the fuse and the input bus bar to the case such that the input terminal is laid to overlap the input bus bar; and an output-side fastening member which fastens an output terminal of the fuse and the output bus bar to the case such that the output terminal is laid to overlap the output bus bar, wherein the input-side fastening member and the output-side fastening member are conductive and are passed through the case, and a connecting terminal of the input electric wire is fastened to the case at a distal end portion of the input-side fastening member which is exposed from the case, and a connecting terminal of the output electric wire is fastened to the case at a distal end portion of the output-side fastening member which is exposed from the case.

* * * * *